US006684856B2

(12) United States Patent
Tanabe et al.

(10) Patent No.: US 6,684,856 B2
(45) Date of Patent: Feb. 3, 2004

(54) FUEL INJECTION APPARATUS OF ENGINE

(75) Inventors: Keiki Tanabe, Tokyo (JP); Shinji Nakayama, Tokyo (JP); Susumu Kohketsu, Tokyo (JP)

(73) Assignee: Mitsubishi Fuso Truck and Bus Corporation, Tokyo (JP)

( * ) Notice: Subject to any disclaimer, the term of this patent is extended or adjusted under 35 U.S.C. 154(b) by 0 days.

(21) Appl. No.: 10/294,893

(22) Filed: Nov. 15, 2002

(65) Prior Publication Data

US 2003/0150426 A1 Aug. 14, 2003

(30) Foreign Application Priority Data

Nov. 16, 2001 (JP) ..... 2001-351177

(51) Int. Cl.[7] ..... F02M 37/04

(52) U.S. Cl. ..... 123/447; 123/198 D; 123/496; 123/467

(58) Field of Search ..... 123/447, 496, 123/456, 300, 299, 198 D, 467

(56) References Cited

U.S. PATENT DOCUMENTS

| | | | | | |
|---|---|---|---|---|---|
| 5,622,512 | A | * | 4/1997 | Uchida | 123/446 |
| 6,092,509 | A | * | 7/2000 | Tanabe | 123/447 |
| 6,112,721 | A | * | 9/2000 | Kouketsu | 123/447 |
| 6,192,862 | B1 | * | 2/2001 | Tanabe et al. | 123/447 |
| 6,457,453 | B1 | * | 10/2002 | Tanabe et al. | 123/300 |
| 6,499,465 | B1 | * | 12/2002 | Mahr et al. | 123/447 |
| 6,520,152 | B1 | * | 2/2003 | Mahr et al. | 123/447 |
| 6,598,590 | B1 | * | 7/2003 | Mahr | 123/447 |

* cited by examiner

*Primary Examiner*—Carl S. Miller
(74) *Attorney, Agent, or Firm*—Birch, Stewart, Kolasch & Birch, LLP

(57) ABSTRACT

By setting a switching timing of switching means that connects either one of a high pressure fuel source and a low pressure fuel source to an injector earlier than a point of time when an injector finishes a high pressure fuel injection, leak fuel or return fuel is reduced and an engine load is reduced and therefore mileage is improved.

6 Claims, 8 Drawing Sheets

INJECTION RATE
ΔTo
ΔTclose

BOOSTER PISTON ELECTROMAGNETIC VALVE 43
ON
OFF
ΔTc

INJECTOR DRIVING ELECTROMAGNETIC VALVE 28
ON
OFF
ΔTi
TIME

FUEL INJECTION APPARATUS OF ENGINE

This nonprovisional application claims priority under 35 U.S.C. § 119(a) on Patent Application No. 2001-3511177 filed in Japan on Nov. 16, 2001, which is herein incorporated by reference.

BACKGROUND OF THE INVENTION

1. Field of the Invention

The present invention relates to a fuel injection apparatus capable of improving mileage by reducing return fuel and leak fuel while excellently maintaining a shape of an injection rate waveform.

2. Description of Related Art

A common rail type fuel injection apparatus is known as a fuel injection apparatus of a diesel engine. According to such a common rail type fuel injection apparatus, injection pressure and injection timing can be controlled independently from each other. Thus, the common rail type fuel injection apparatus is becoming a mainstream as an injection system of a diesel engine for an automobile. However, according to a conventional common rail type fuel injection apparatus, a timing of closing a control valve (first control valve) for controlling to start and stop fuel injection by the injector and a timing of closing a control valve (second control valve) for controlling to supply and stop high pressure fuel to the injector are made to coincide with each other so as to provide the stable injection rate waveform. If necessary, the timing of closing the second control valve is retarded with respect to the timing of closing the first control valve.

This signifies that a time period in which high pressure fuel acts on the injector and the like is prolonged. Therefore, leak fuel or return fuel is increased. The leak fuel is a small amount of fuel leaked out from a seal portion of the injector when the high pressure fuel acts on the injector. The return fuel is a fuel returned from the common rail to a fuel tank without contributing to fuel injection.

The increase in the leak fuel or the return fuel signifies an increase in an amount of driving work of a fuel supply pump for supplying fuel to the common rail. As a result, the engine for driving the fuel supply pump is obliged to carry out unnecessary work, constituting a factor of a deterioration in fuel consumption.

SUMMARY OF THE INVENTION

The invention resolves such a problem and it is an object thereof to provide a fuel injection apparatus capable of reducing return fuel or leak fuel while excellently maintaining a shape of an injection rate waveform to thereby improve mileage.

A fuel injection apparatus of an engine according to the invention includes: a high pressure fuel source capable of supplying a high pressure fuel; a low pressure fuel source capable of supplying a fuel at a pressure lower than a fuel pressure of the high pressure fuel source; switching means; an injector connected to the high pressure fuel source and the low pressure fuel source via the switching means; and controlling means for controlling switching of the fuel sources by the switching means and operation of the injector; wherein the controlling means switches the fuel source for supplying the fuel to the injector from the high pressure fuel source to the low pressure fuel source a predetermined time period earlier from a point of time when the injector finishes an injection of the high pressure fuel.

Since a timing of switching the switching means for selecting either one of the high pressure fuel source and the low pressure fuel source so as to communicate to the injector is set to be earlier than a point of time when the injector finishes the fuel injection, a time period in which high pressure fuel acts on the injector is shortened to thereby reduce leak fuel. In the case of a fuel injection apparatus of a two common rails type, a time period in which high pressure acts on a low-pressure common rail is shortened to thereby reduce return fuel. The leak fuel or the return fuel is reduced in this way and therefore, wasteful supply of fuel to the high pressure fuel source or the low pressure fuel source can be restrained and load of the engine can be reduced to thereby improve mileage.

DETAILED DESCRIPTION OF THE PREFERRED EMBODIMENTS

Preferred embodiments of the invention will be described with reference to accompanying drawings.

<First Embodiment: Fuel Injection Apparatus of Two Common Rails Type>

First, an explanation will be given of a first embodiment in which the invention is applied to a fuel injection apparatus of a two common rails type having a high-pressure common rail and a low-pressure common rail.

Figure 1:
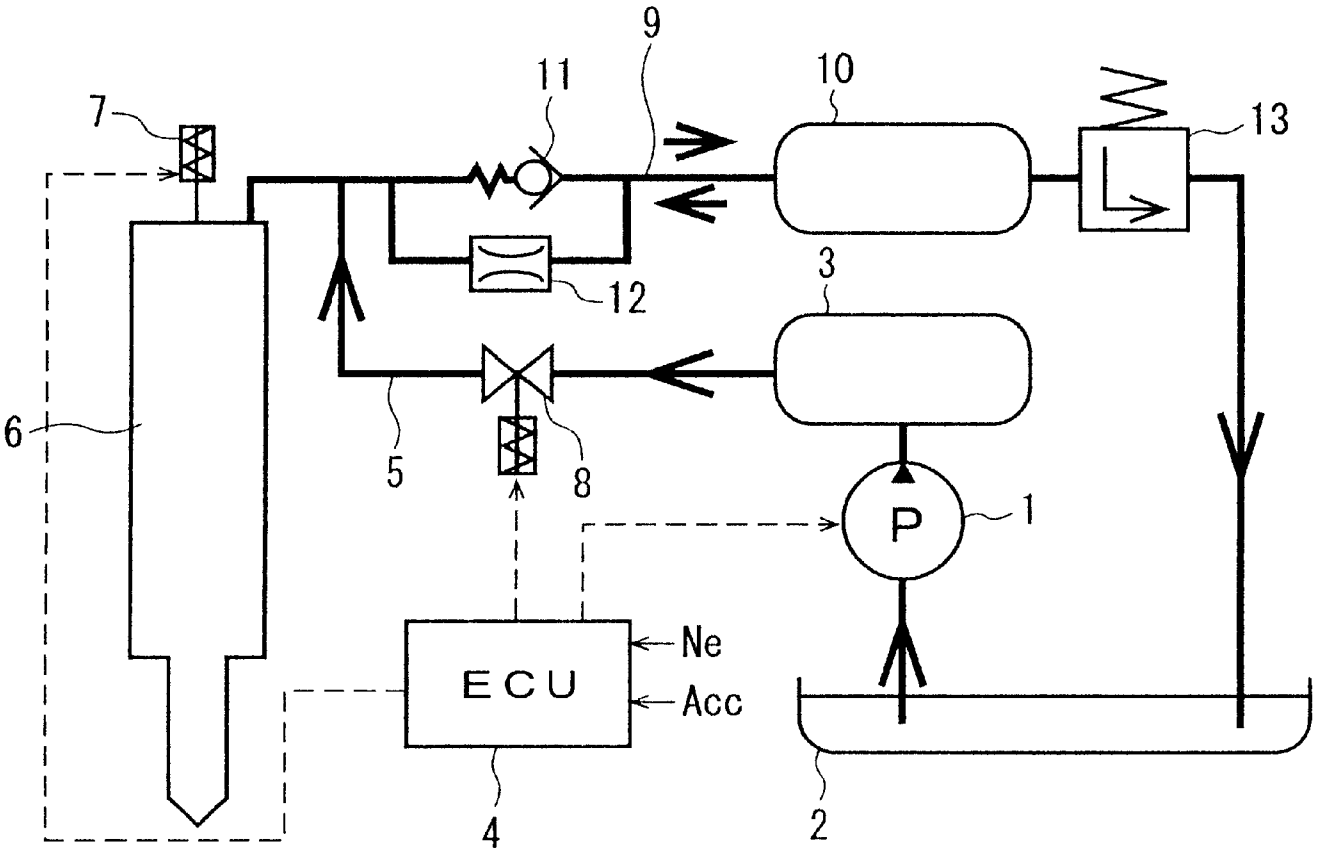
FIG. 1 is a constitution diagram showing a fuel injection apparatus of a two common rails type according to a first embodiment of the invention.

As shown by FIG. 1, according to a fuel injection apparatus of a two common rails type, a high pressure fuel supply pump 1 pressurizes fuel supplied from a feed pump (not illustrated) from inside of a fuel tank 2 by being driven by an engine as an internal combustion engine and delivers fuel at high pressure to a high-pressure common rail 3. An electronic control apparatus 4 variably controls a pressurizing stroke (fuel supply amount) by controlling the high pressure fuel supply pump 1 in accordance with an engine revolution number Ne detected by an engine revolution number sensor and an accelerator pedal depressing amount (accelerator opening degree) Acc detected by an accelerator opening degree sensor. Also, the electronic control apparatus 4 performs a feedback control of the pressurizing stroke in accordance with fuel pressure detected by a pressure sensor (not illustrated) provided at the high-pressure common rail 3 to thereby provide high pressure fuel adapted to an engine operating state.

High pressure fuel delivered from the high-pressure fuel supply pump 1 is stored in the high-pressure common rail 3. The high-pressure common rail 3 is common to respective cylinders of the engine and is connected to an injector 6 via a fuel path 5. The injector 6 is provided with an injector driving electromagnetic valve (first control valve) 7 and a pressure switching electromagnetic valve (second control valve) 8 is interposed at a middle of the fuel path 5. Control of ON and OFF of the electromagnetic valves 7 and 8 is carried out by the electronic control apparatus 4.

A branch fuel path 9 is branched from a portion of the fuel path 5 that is downstream from the pressure switching electromagnetic valve 8 (portion of the injector 6 side) and a low-pressure common rail 10 is connected to the injector 6 via the branch fuel path 9. A check valve 11 and an orifice 12 are connected to a middle of the branch fuel path 9 in parallel and the check valve 11 permits flow of fuel directed from the low-pressure common rail 10 to the injector 6. When fuel pressure in the fuel path 5 is higher than fuel pressure in the branch fuel path 9, fuel in the fuel path 5 flows into the low-pressure common rail 10 via the branch fuel path 9 and the orifice 12. A pressure control valve 13 for controlling fuel pressure of the low-pressure common rail 10 is provided between the low-pressure common rail 10 and the fuel tank 2 in the branch fuel path 9. Fuel pressure in the low-pressure common rail 10 can be controlled to previously determined low pressure by controlling pressure by the pressure control valve 13. The pressure control valve 13 may variably be controlled by the electronic control apparatus 4.

Next, an explanation will be given of operation of the two common rail type fuel injection apparatus having such a constitution. Under control of the electronic control apparatus 4, fuel pressure in the high-pressure common rail 3, that is, delivery pressure of the high-pressure fuel supply pump 1 is controlled to adapt to an engine operating state and fuel injection time period (fuel injection start and finish timings) are set in accordance with the engine operating state (engine revolution number Ne, accelerator pedal depressing amount Acc).

The low-pressure common rail 10, the branch fuel path 9 and the fuel path 5 downstream from the pressure switching electromagnetic valve 8 are filled with fuel, pressure of which is controlled to low pressure by the pressure control valve 13.

The electronic control apparatus 4 can change a fuel injection rate waveform as follows by controlling timings of ON and OFF of the electromagnetic valves 7 and 8.

Figures 2A, 2B, 2C:
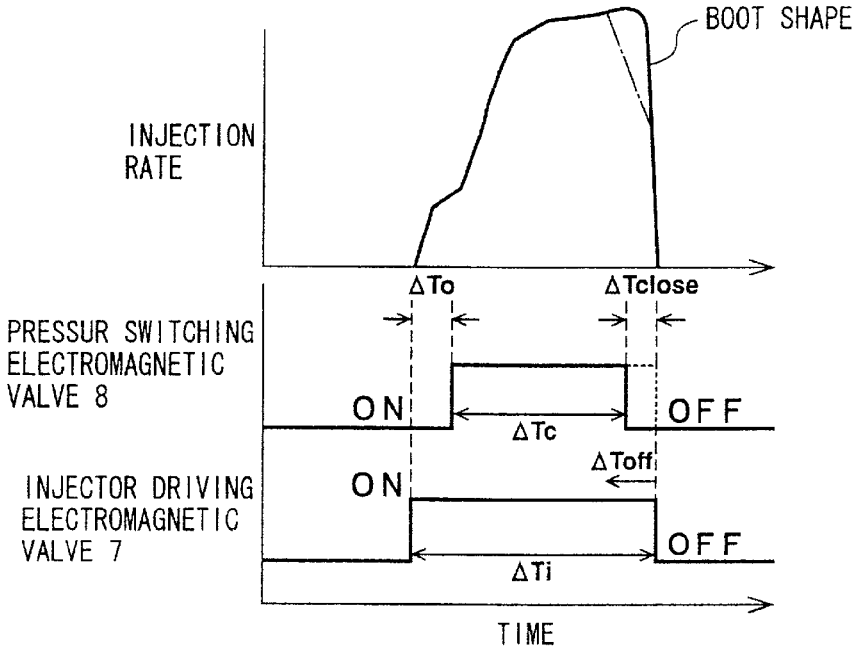
FIGS. 2A, 2B and 2C are explanatory views showing an injection rate waveform of a boot shape and a state of driving an electromagnetic valve according to the first embodiment of the invention.

As shown by FIGS. 2B and 2C, when the injector driving electromagnetic valve 7 is opened in a state in which the pressure switching electromagnetic valve 8 is closed, fuel at low pressure is supplied from the low-pressure common rail 10 to the injector 6 to thereby inject low pressure fuel.

When the pressure switching electromagnetic valve 8 is opened retardedly over time since the injector driving electromagnetic valve 7 has been opened, fuel at high pressure is supplied from the high-pressure common rail 3 to the injector 6 to thereby inject high pressure fuel.

When the low pressure fuel is injected at an initial state of injection time and the high pressure fuel is injected retardedly by a predetermined time period in this way, as shown by a solid line in FIG. 2A, the injection rate waveform becomes a boot shape.

Figures 3A, 3B, 3C:
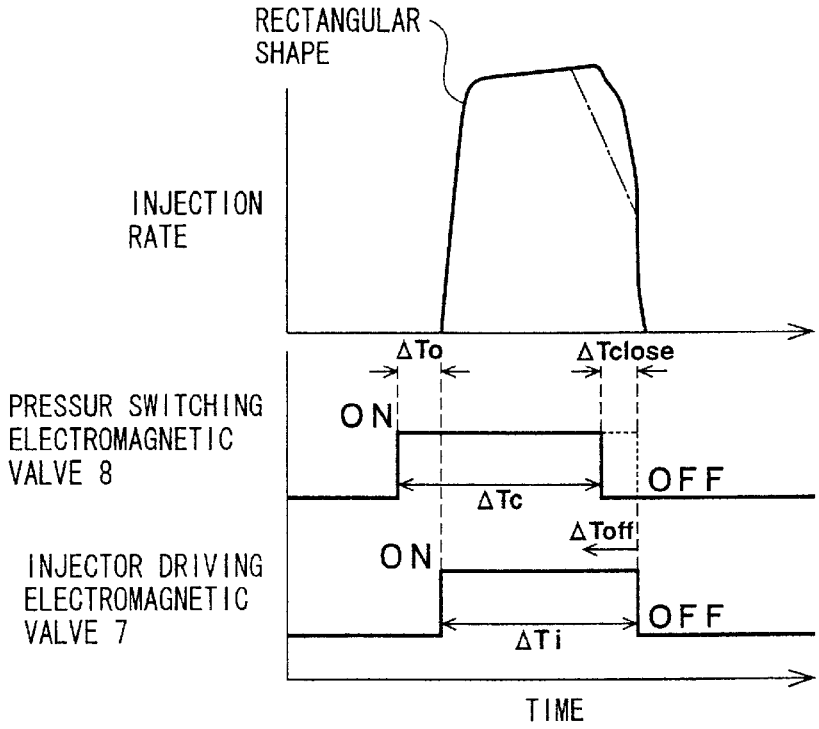
FIGS. 3A, 3B and 3C are explanatory views showing an injection rate waveform of a rectangular shape and a state of driving the electromagnetic valve according to the first embodiment of the invention.

As shown by FIGS. 3B and 3C, when the pressure switching electromagnetic valve 8 is opened prior to opening the injector driving electromagnetic valve 7, fuel at high pressure is supplied to a side of the fuel path 5 downstream from the pressure switching electromagnetic valve 8. When the injector driving electromagnetic valve 7 is opened in a state in which the high pressure fuel has previously been supplied in this way, an injection amount is rapidly increased immediately after starting to inject fuel and a large amount of fuel can be injected in a short period of time. Therefore, the injection rate waveform in this case becomes substantially a rectangular shape as shown by a bold line in FIG. 3A.

In this way, by controlling timings of opening the injector driving electromagnetic valve 7 and the pressure switching electromagnetic valve 8, the shape of the injection rate waveform can be changed. That is, the shape of the injection rate waveform can be controlled to the boot shape injection rate waveform in which the injection amount is gradually increased immediately after starting to inject fuel and to the rectangular injection rate waveform in which the injection amount is rapidly increased immediately after starting to inject fuel and a large amount of fuel is injected. The shape of the injection rate waveform can further be constituted by other shape by controlling the timings of opening the injector driving electromagnetic valve 7 and the pressure switching electromagnetic valve 8 so as to differ from the above-described timings.

When the pressure switching electromagnetic valve 8 is opened, fuel at high pressure is supplied to the low-pressure common rail 10 via the orifice 12 of the branch fuel path 9. Pressure in the low-pressure common rail 10 is controlled to predetermined low pressure by the pressure control valve 13. That is, when the pressure in the low-pressure common rail 10 becomes larger than control pressure controlled by the pressure control valve 13, fuel in the low-pressure common rail 10 flows out via the pressure control valve 13 and returns to the fuel tank 2. The fuel returning from the low-pressure common rail 10 to the fuel tank 2 via the pressure control valve 13 in this way is referred to as "return fuel".

Further, when fuel is supplied to the injector 6 (particularly, when high pressure fuel is supplied thereto), since fuel pressure is high, fuel leaks out from a seal portion of the injector 6 although an amount thereof is small, and returns to the fuel tank 2. The fuel leaking out from the seal portion of the injector 6 and returning to the fuel tank 2 in this way is referred to as "leak fuel".

An explanation will be given here of timings of closing the electromagnetic valves (first, second control valve) 7 and 8 at a final stage of the injection time, a feature of the invention. As shown by solid lines in FIGS. 2B and 2C and FIGS. 3B and 3C, the timing of closing the pressure switching electromagnetic valve (second control valve) 8 is set to be earlier over time than the timing of closing the injector driving electromagnetic valve (first control valve) 7 by a predetermined time period ΔTclose. The predetermined time period ΔTclose is calculated as a time interval (period) by which the shape of the injection rate waveform can excellently be maintained and an opening time period ΔTc of the pressure switching electromagnetic valve 8 is minimized (that is, a time period in which high pressure fuel acts on the injector 6 and the low-pressure common rail 10 is minimized). A method of setting and calculating the predetermined timed period will be described later.

In the related art, as shown by dotted lines in FIG. 2B and FIG. 3B, the timing of closing the pressure switching electromagnetic valve (second control valve) 8 is made to coincide with the timing of closing the injector driving electromagnetic valve (first control valve) 7.

According to the embodiment, the timing of closing the pressure switching electromagnetic valve 8 is made earlier than the timing of closing the injector driving electromagnetic valve 7. Therefore, a period of time in which high pressure fuel acts on the injector 6 and the low-pressure common rail 10 is shortened. As a result, leak fuel from the injector 6 or return fuel from the low-pressure common rail 10 is reduced, work of driving the high pressure fuel supply pump 1 is reduced. Thus, load of the engine is reduced and mileage is improved.

Figure 4A:
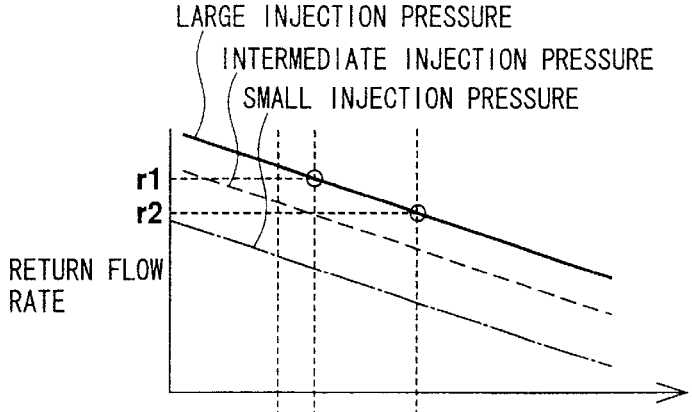
FIGS. 4A and 4B are characteristic diagrams showing relationships between advance time ΔToff and a return flow rate and an injection amount according to the invention.
Figure 4B:
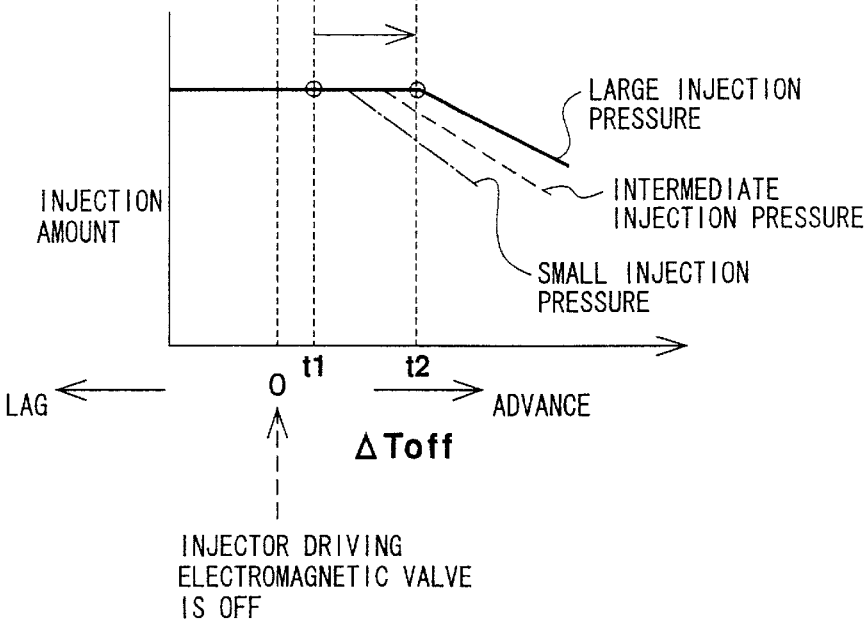

An explanation will be given here of relationships between a period of time (advance time ΔToff) defined between the timing of closing the pressure switching electromagnetic valve 8 and the timing of closing the injector driving electromagnetic valve 7 and a flow rate of return fuel (return flow rate) and the injection amount with reference to FIGS. 4A and 4B. In FIGS. 4A and 4B, the advance time ΔToff indicates time earlier than time 0 when the injector driving electromagnetic valve 7 is closed.

FIG. 4A shows the relationship between the advance time ΔToff and the return flow rate. Although there are a plurality of characteristics in accordance with large or small of the injection pressure, the relationship shows that the longer the advance time ΔToff, the more the return flow rate is reduced.

FIG. 4B shows the relationship between the advance time ΔToff and the injection amount. Although there are a plurality of characteristics in accordance with large or small of the injection pressure, the relationship shows that when the advance time ΔToff becomes longer than a certain time period, the injection amount is reduced and an aimed injection rate waveform is not provided. That is, in the characteristic of FIG. 4B, when the advance time ΔToff becomes longer than a certain time period, the injection amount is reduced down to an amount shown by a drooping characteristic.

As shown by FIG. 4A, when the advance time ΔToff is set to t1, the return flow rate is r1. When the advance time ΔToff is set to t2, the return flow rate is reduced down to r2. In this case, when the advance time ΔToff is set to a time period capable of ensuring the injection amount to a degree of not influencing on the injection rate waveform, the return flow rate can be reduced while maintaining the injection rate waveform. Such a time period differs by the injection pressure as shown by FIG. 4A and therefore, it is necessary to take the injection pressure (fuel pressure) into consideration. Further, such a time period differs also by fuel temperature.

Figure 5:
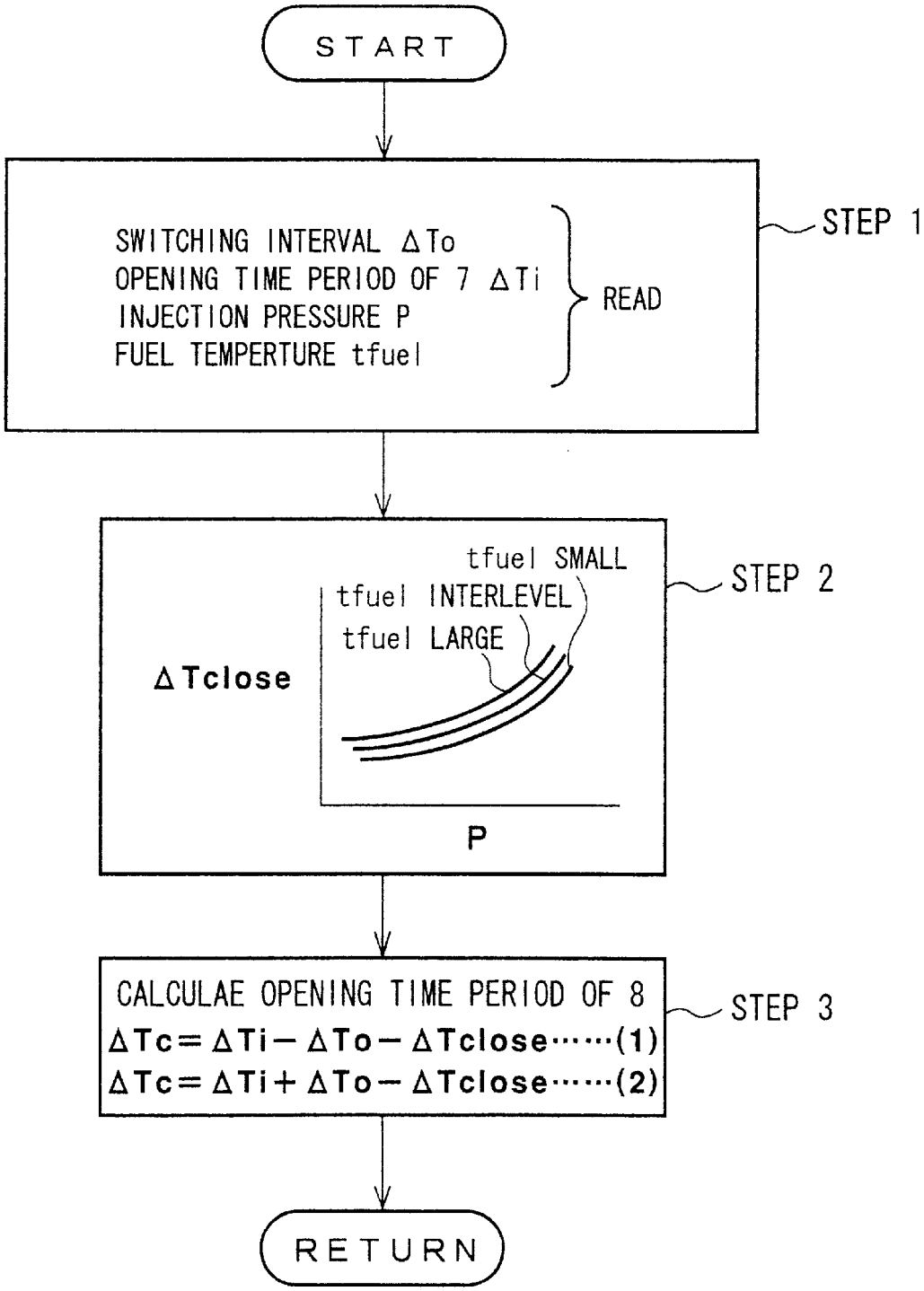
FIG. 5 is a flowchart showing operation of an electronic control apparatus according to the first embodiment of the invention.

A characteristic shown in step 2 of FIG. 5 shows a characteristic capable of calculating the advance time ΔToff, that is, predetermined time period ΔTclose capable of reducing the return flow rate while maintaining the injection rate waveform in accordance with the injection pressure (fuel pressure) P and the fuel temperature tfuel. According to the characteristic, the higher the injection pressure P and the higher the fuel temperature tfuel, the longer the predetermined time period ΔTclose. Such a characteristic is previously calculated in accordance with a characteristic of respective engine and is integrated to the electronic control apparatus 4.

An explanation will be given here of a calculating procedure of calculating advance time ΔToff (=predetermined time period ΔTclose) capable of reducing the return flow rate while maintaining the injection rate waveform, and the opening time period ΔTc of the pressure switching electromagnetic valve 8 with reference to a flowchart of FIG. 5.

At step 1, the electronic control apparatus 4 reads a switching interval ΔTo, an opening time period ΔTi of the injector driving electromagnetic valve 7, the injection pressure P and the fuel temperature tfuel. The switching interval ΔTo which is a time interval between the timing of opening the electromagnetic valve 7 and the timing of opening the electromagnetic valve 8 is determined in accordance with the injection rate waveform and is determined based on the engine operating state (engine revolution number Ne, accelerator pedal depressing amount Acc). The opening time period ΔTi of the injector driving electromagnetic valve 7 is determined also based on the engine operating state (engine revolution number Ne, accelerator pedal depressing amount Acc). The injection pressure P is detected by the pressure sensor (not illustrated) provided at the high-pressure common rail 3. The fuel pressure tfuel is detected by a temperature sensor (not illustrated) provided at the high-pressure common rail 3.

At step 2, a characteristic in accordance with the fuel temperature tfuel is selected and by using the selected characteristic, the predetermined time period ΔTclose in correspondence with the injection pressure P at this occasion is calculated.

At step 3, the opening time period of the pressure switching electromagnetic valve 8 is calculated by the following Equation (1) or (2). Equation (1) is used when the timing of opening the injector driving electromagnetic valve 8 is retarded with respect to the timing of opening the pressure switching electromagnetic valve 8, for example, when the injection rate waveform is a boot shape. Equation (2) is used when the timing of opening the injector driving electromagnetic valve 7 is earlier than the timing of opening the pressure switching electromagnetic valve 8, that is, when the injection rate waveform is a rectangular shape.

$$\Delta Tc=\Delta Ti-\Delta To-\Delta Tclose \quad (1)$$

$$\Delta Tc=\Delta Ti+\Delta To-\Delta Tclose \quad (2)$$

The electronic control apparatus 4 closes the injector driving electromagnetic valve 7 at a time point at which the valve opening time period ΔTc calculated by Equation (1) or Equation (2) has elapsed from a time point at which the pressure switching electromagnetic valve 8 is closed. Therefore, the timing of closing the pressure switching electromagnetic valve 8 becomes earlier than the timing of closing the injector driving electromagnetic valve 7 by the predetermined time period ΔTclose.

When the time period between the timing of closing the pressure switching electromagnetic valve 8 and the timing of closing the injector driving electromagnetic valve 7 becomes longer than the predetermined time period ΔTclose, at the final stage of the injection time period, high pressure fuel becomes deficient as shown by one-dotted chain lines in FIG. 2A and FIG. 3A, at the final stage of the injection time period, the injection rate waveform is significantly deformed. Thus, desired output torque is not provided and a problem caused.

After all, by constituting the time period between the timing of closing the pressure switching electromagnetic valve 8 and the timing of closing the injector driving electromagnetic valve 7 by the predetermined time period ΔTclose, the leak fuel or the return fuel can be reduced while excellently maintaining the injection rate waveform.

The predetermined time period ΔTclose set in accordance with the fuel pressure may be corrected taking the fuel temperature into account.

<Second Embodiment: Fuel Injection Apparatus of Booster Piston Type>

Figure 6:
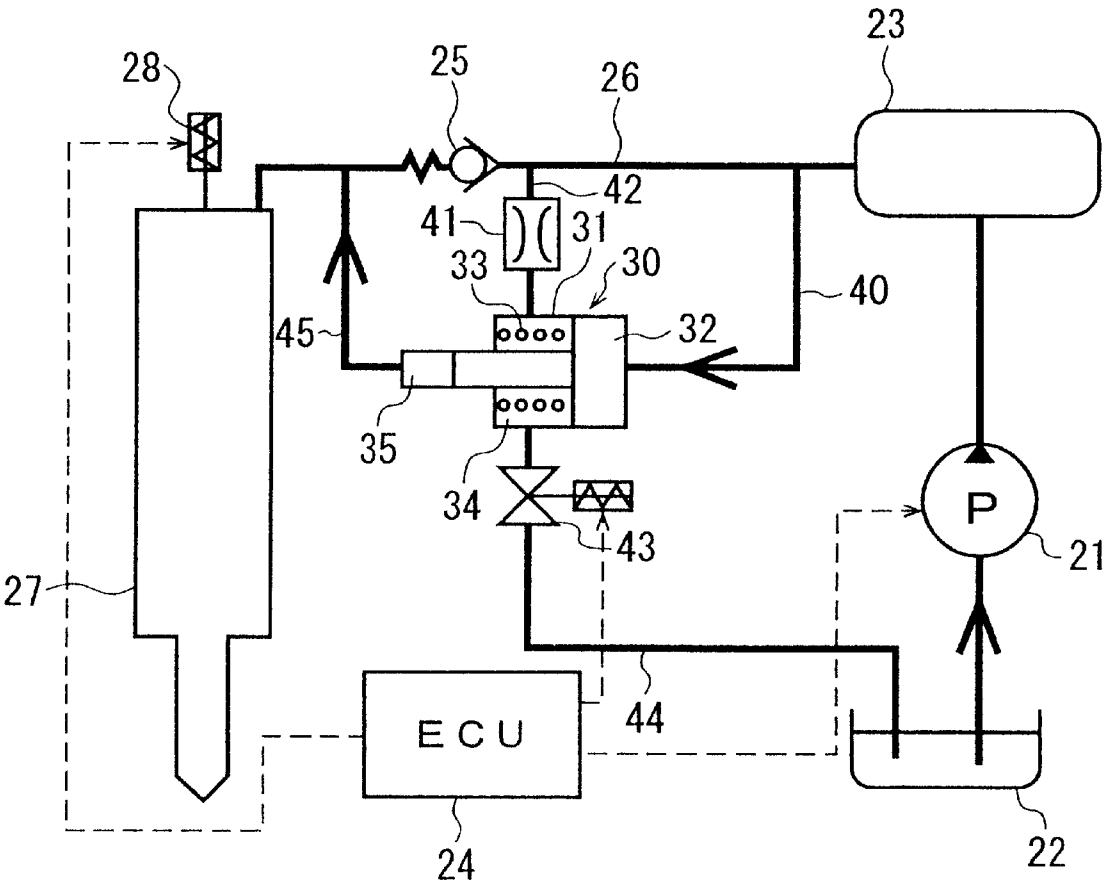
FIG. 6 is a constitution diagram showing a fuel injection apparatus of a booster piston type according to a second embodiment of the invention.

Next, an explanation will be given of a second embodiment in which the invention is applied to a fuel injection apparatus of a booster piston type having a fuel boosting mechanism. As shown by FIG. 6, according to a fuel injection apparatus of a booster piston type, a fuel supply pump 21 pressurizes fuel supplied from a fuel tank 22 by a feed pump (not illustrated) by being driven by an engine and delivers fuel at low pressure to a common rail 23. The electronic control apparatus 24 variably controls a pressurizing stroke (fuel supply amount) of the fuel supply pump 21 in accordance with an engine operating condition.

Low pressure fuel delivered from the fuel supply pump 21 is stored in the common rail 23. The common rail 23 is common to respective cylinders of the engine and is connected to an injector 27 via a fuel path 26 interposed with a check valve 25. The injector 27 is provided with an injector driving electromagnetic valve (first control valve) 28.

The fuel boosting mechanism is mainly constituted by a booster piston 30, an orifice 41 and a booster piston electromagnetic valve 43. The booster piston 30 is provided with a cylinder 31, a piston 32 and a return spring 33 and is provided with a cylinder chamber 34 and a pressurizing chamber 35. Further, a portion of the fuel path 26 on a side of the common rail 23 (upstream side) with respect to the check valve 25 and a back face space of the piston 32 (in FIG. 6, space in the cylinder on the right side of the piston 32) are connected by a path 40. Further, a portion of the fuel path 26 on a side upstream from the check valve 25 and the cylinder chamber 34 are connected by a path 42 interposing the orifice 41. Further, the cylinder chamber 34 and the fuel tank 22 are connected by a path 44 interposing the booster piston electromagnetic valve (second control valve) 43. Further, a portion of the fuel path 26 on a side of the injector 27 with respect to the check valve 25 (downstream side) and the pressurizing chamber 35 are connected by a path 45.

An electronic control apparatus 24 can change an injection rate waveform of fuel as follows by controlling timings of ON and OFF of the electromagnetic valves 28 and 43.

Figures 7A, 7B, 7C:
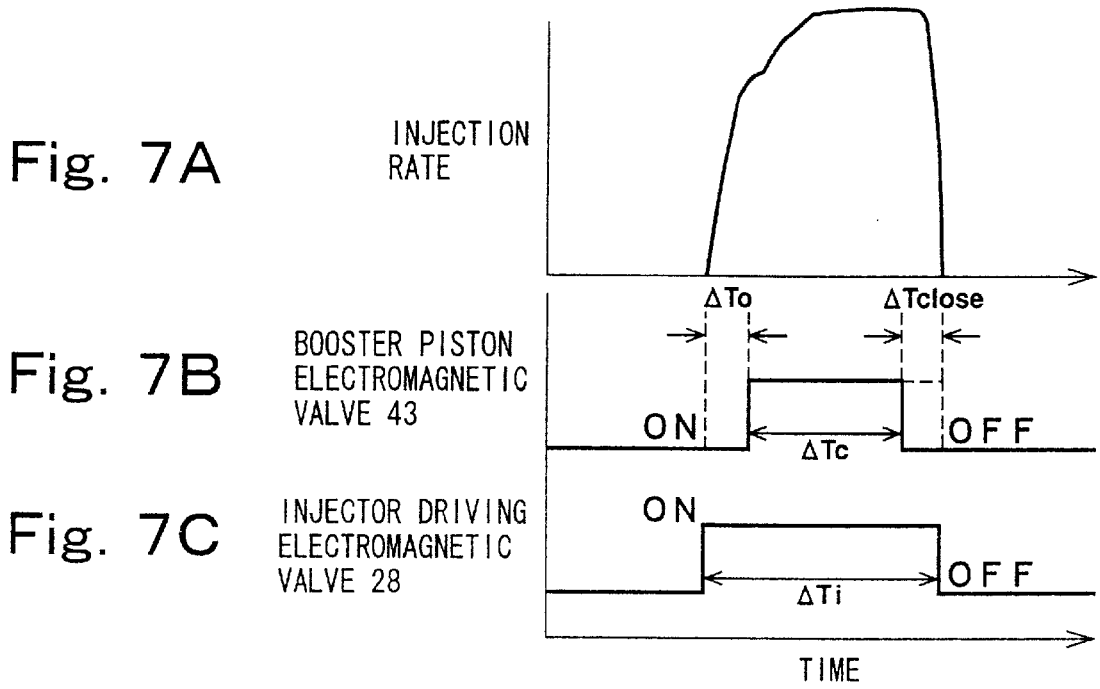
FIGS. 7A, 7B and 7C are explanatory views showing an injection rate waveform restraining initial injection and a state of driving an electromagnetic valve according to the second embodiment of the invention.

As shown by FIGS. 7B and 7C, when the injector driving electromagnetic valve 28 is opened in a state in which the booster piston electromagnetic valve 43 is closed, fuel at low pressure is supplied from the common rail 23 to the injector 27 via the fuel path 26 and the check valve 25 to thereby inject low pressure fuel.

When the booster piston electromagnetic valve 43 is opened retardedly over time since the injector driving electromagnetic valve 28 has been opened, fuel in the cylinder chamber 34 flows out to the fuel tank 22 by passing the path 44, pressure in the cylinder chamber 34 becomes lower than pressure at the back face of the piston 32, the piston 32 is pushed to a side of the pressurizing chamber 35 and fuel in the pressurizing chamber 35 is brought under high pressure and supplied to the injector 27 via the path 45 to thereby inject high pressure fuel.

When low pressure fuel is injected at the initial stage of an injection time period and high pressure fuel is injected retardedly by a predetermined time period, as shown by FIG. 7A, an injection rate waveform restraining initial injection can be constituted.

Figures 8A, 8B, 8C:
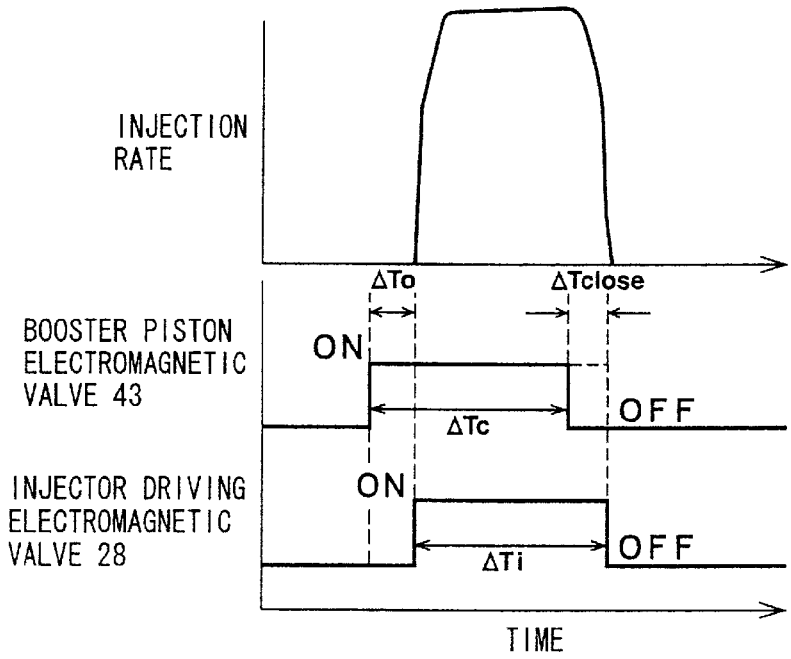
FIGS. 8A, 8B and 8C are explanatory views showing an injection rate waveform of a rectangular shape and a state of driving the electromagnetic valve according to the second embodiment of the invention.

As shown by FIGS. 8B and 8C, when the booster piston electromagnetic valve 43 is opened prior to opening the injector driving electromagnetic valve 28, fuel in the cylinder chamber 34 flows out to the fuel tank 22 by passing the path 44, the piston 32 is moved by being pushed to the side of the pressurizing chamber 35 and fuel in the pressurizing chamber 35 is brought under high pressure and supplied to a side of the fuel path 26 downstream from the check valve 25. When the injector driving electromagnetic valve 28 is opened in a state in which high pressure fuel is being supplied in this way, the injection amount is increased rapidly immediately after starting to inject fuel and a large amount of fuel can be injected in a short period of time. Therefore, as shown by FIG. 8A, the injection rate waveform in this case becomes substantially a rectangular shape.

An explanation will be given here of timings of closing the electromagnetic valves (first, second control valve) 28 and 43 at a final stage of the injection time period, the feature of the invention. As shown by solid lines in FIGS. 7B and 7C and FIGS. 8B and 8C, the timing of closing the booster piston electromagnetic valve (second control valve) 43 is set to be earlier than the timing of closing the injector driving electromagnetic valve (first control valve) 28 by a predetermined time period ΔTclose. The predetermined time period ΔTclose is calculated as a time interval (period) by which the shape of the injection rate waveform can excellently be maintained and an opening time period ΔTc of the booster piston electromagnetic valve 43 is minimized (that is, time period in which high pressure fuel acts on the injector 38 is minimized). A method of setting and calculating the predetermined time period ΔTclose is similar to that in the first embodiment, mentioned above.

In the related art, as shown by dotted lines in FIG. 7B and FIG. 8B, the timing of closing the booster piston electromagnetic valve (second control valve) 43 is made to coincide with the timing of closing the injector driving electromagnetic valve (first control valve) 28.

According to the embodiment, since the timing of closing the booster piston electromagnetic valve 43 is made earlier than the timing of closing the injector driving electromagnetic valve 28, a period of time in which high pressure fuel acts on the injector 27 is shortened. As s result, leak fuel from the injector 6 is reduced, work for driving the high pressure fuel supply pump 1 is reduced and therefore, load of the engine is reduced and fuel cost is improved.

What is claimed is:

1. A fuel injection apparatus of an engine, the fuel injection apparatus comprising:

a high pressure fuel source capable of supplying a high pressure fuel;

a low pressure fuel source capable of supplying a fuel at a pressure lower than a fuel pressure of the high pressure fuel source;

switching means;

an injector connected to the high pressure fuel source and the low pressure fuel source via the switching means; and controlling means for controlling switching of the fuel sources by the switching means and operation of the injector;

wherein the controlling means switches the fuel source for supplying the fuel to the injector from the high pressure fuel source to the low pressure fuel source a predetermined time period earlier than a point of time when the injector finishes an injection of the high pressure fuel.

2. The fuel injection apparatus of an engine according to claim 1:

wherein the predetermined time period is set within a range in which a decrease of injector injection rate caused by switching the fuel source for supplying the fuel to the injector from the high pressure fuel source to the low pressure fuel source does not affect before the injector finishes the injection.

3. The fuel injection apparatus of an engine according to claim 1:

wherein the predetermined time period is set in accordance with the fuel pressure of the high pressure fuel source.

4. The fuel injection apparatus of an engine according to claim 1:

wherein the predetermined time period is set in accordance with a fuel temperature of the high pressure fuel source.

5. The fuel injection apparatus of an engine according to claim 1:

wherein the high pressure fuel source is a high-pressure common rail for storing the high pressure fuel and the low pressure fuel source is a low-pressure common rail for storing the fuel supplied from the high pressure common rail and controlling a pressure of the fuel so as to constitute the low pressure fuel.

6. The fuel injection apparatus of an engine according to claim 1:

wherein the low pressure fuel source is a low-pressure common rail for storing the low pressure fuel and the high pressure fuel source is a fuel boosting mechanism activated by the switching of the switching means for boosting the low pressure fuel.

* * * * *